US009759416B2

(12) United States Patent
Boyer et al.

(10) Patent No.: US 9,759,416 B2
(45) Date of Patent: Sep. 12, 2017

(54) LUMINAIRES AND THERMAL MANAGEMENT APPARATUSES

(71) Applicant: LSI Industries, Inc., Cincinnati, OH (US)

(72) Inventors: John D. Boyer, Lebanon, OH (US); Eric Jon Mooar, Liberty Township, OH (US); Edward R. McCracken, Jr., Cincinnati, OH (US); Daniel Hutchens, Cold Spring, KY (US); Travis Meyers Schubert, Cincinnati, OH (US)

(73) Assignee: LSI industries, Inc., Cincinnati, OH (US)

( * ) Notice: Subject to any disclaimer, the term of this patent is extended or adjusted under 35 U.S.C. 154(b) by 64 days.

(21) Appl. No.: 14/798,782

(22) Filed: Jul. 14, 2015

(65) Prior Publication Data

US 2017/0016608 A1 Jan. 19, 2017

(51) Int. Cl.

| | |
|---|---|
| ***F21V 29/507*** | (2015.01) |
| ***F21V 29/503*** | (2015.01) |
| *F21Y 105/10* | (2016.01) |
| *F21Y 115/10* | (2016.01) |

(52) U.S. Cl.

CPC ..... *F21V 29/507* (2015.01); *F21V 29/503* (2015.01); *F21Y 2105/10* (2016.08); *F21Y 2115/10* (2016.08)

(58) Field of Classification Search

CPC .... F21V 29/508; F21V 29/70; F21V 19/0015; F21V 5/048; F21V 15/01; F21V 2101/02

USPC ..... 362/235, 97.1, 97.2, 97.3, 97.4

See application file for complete search history.

(56) References Cited

U.S. PATENT DOCUMENTS

| | | | | |
|---|---|---|---|---|
| 8,425,070 | B2 * | 4/2013 | Shin | G02F 1/133605 349/58 |
| 8,459,820 | B2 * | 6/2013 | Lee | G02F 1/133608 362/561 |
| 8,568,014 | B2 * | 10/2013 | Kim | G02F 1/133608 362/225 |
| 8,648,979 | B2 * | 2/2014 | Kuromizu | G02F 1/133608 349/58 |
| 8,848,131 | B2 * | 9/2014 | Yokota | G02F 1/133603 349/61 |
| 2009/0135330 | A1 * | 5/2009 | Kawase | G02F 1/133603 349/58 |

* cited by examiner

*Primary Examiner* — Laura Tso

(74) *Attorney, Agent, or Firm* — McDermott Will and Emery LLP

(57) ABSTRACT

A luminaire has a housing plate on which a circuit board rests. The circuit board has light sources for generating light and circuit board bosses. A lens is biased toward the circuit board and contacts a distal end of the circuit board bosses to press the circuit board against the housing plate.

21 Claims, 6 Drawing Sheets

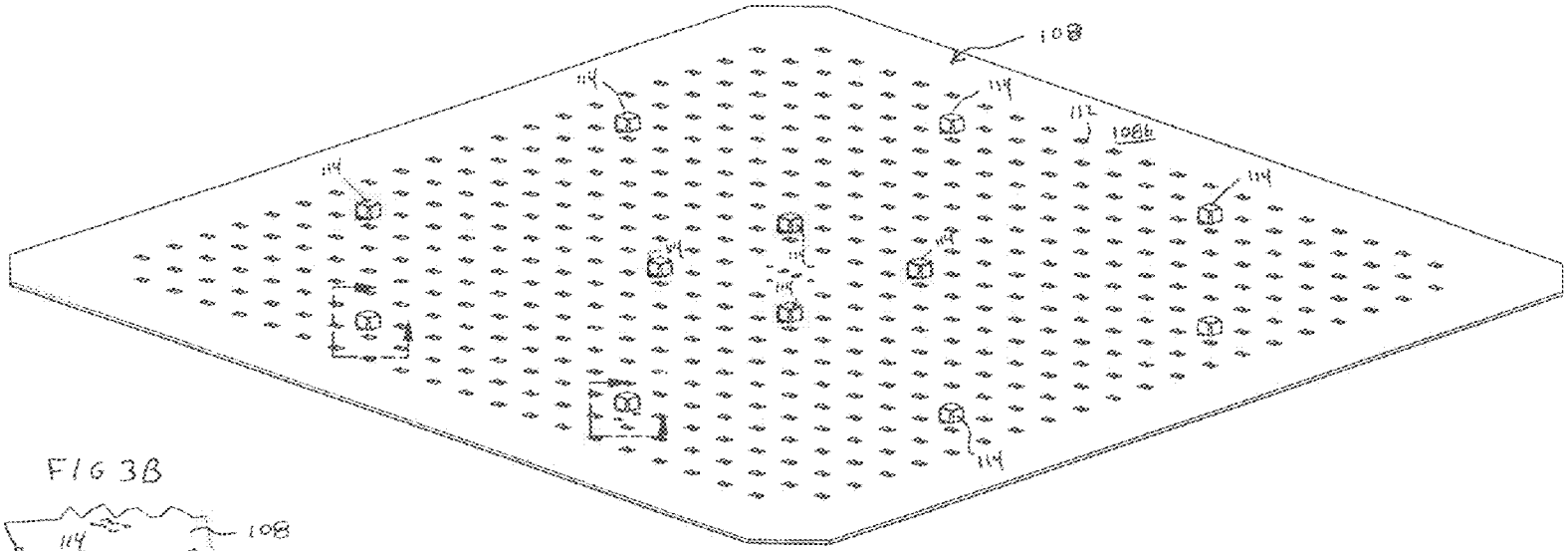
108
108B
114
114
114

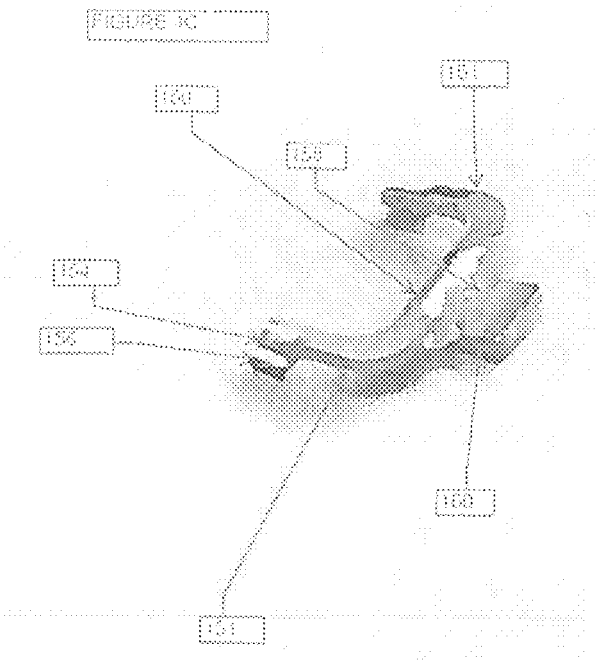
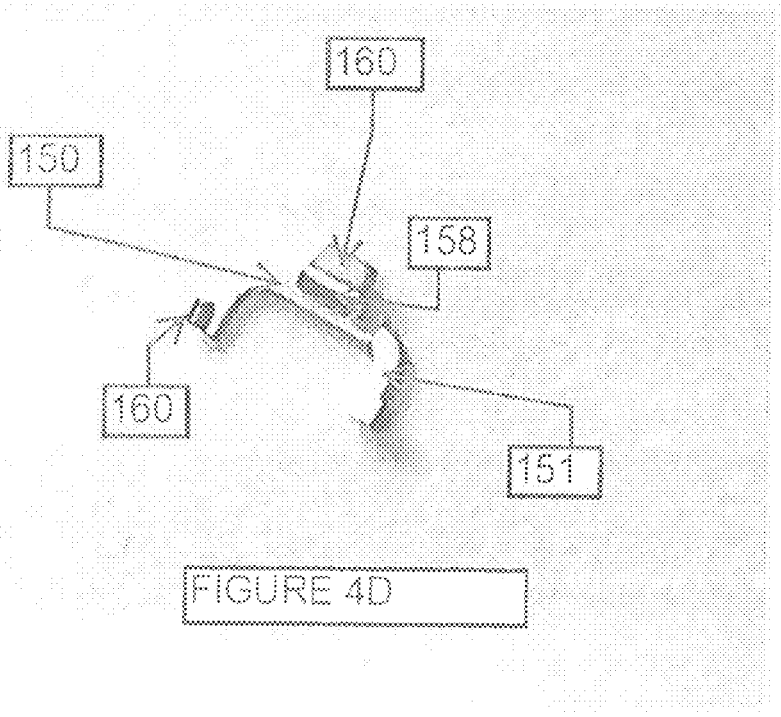
FIGURE 4D

LUMINAIRES AND THERMAL MANAGEMENT APPARATUSES

FIELD OF THE DISCLOSURE

The present disclosure is directed generally to a luminaire for casting light over a desired area. More particularly the present disclosure is directed to a luminaire having a circuit board against a heat sink and a lens enclosing the circuit board in the luminaire with lens spacers between the lens and the circuit board forcing the circuit board against the heat sink to facilitate thermal contact.

BACKGROUND OF THE DISCLOSURE

It is known that some light generating sources (hereinafter "light source") operate more efficiently when their temperature is managed or maintained at certain levels. A light emitting diode (hereinafter "LED") is known to be an efficient light source relative to many other current commercially available light sources. It is also known, however, that the efficiency of LEDs decreases as the temperature of the LED increases. Furthermore, operating an LED at a higher temperature also tends to decrease the lifespan of that LED. When operating LEDs for light-generating purposes, it can therefore be desirable to regulate the temperature of the LEDs and maintain that temperature at a certain preferred operating temperature or in a certain preferred operating temperature range. Light sources other than LEDs would also benefit from temperature regulation.

A luminaire can be designed to act as a heat sink for an associated light source and to dispel heat to the surrounding environment. When a luminaire comprises one or more light sources that are mounted to, or otherwise part of, a circuit board, thermal management of light sources may be accomplished by creating thermal contact between the circuit board and the luminaire so as to allow the luminaire to act as a heat sink. Thermal contact between a circuit board and its associated luminaire has been facilitated by screwing the circuit board to the luminaire or connecting the circuit board to the luminaire by other connectors. Using screws to create a thermal connection between a circuit board and a luminaire necessitates providing a threaded receptacle in or behind the luminaire to receive each screw. Creation of these threaded receptacles is time consuming and costly. Moreover, securing the circuit board to the luminaire with screws in this matter requires careful advancing of the screws in order to avoid damaging the circuit board or stripping the threads in the threaded receptacle. This too becomes time consuming and costly and can result in damaged circuit boards regardless of how carefully the screws are advanced. Similar problems and costs are associated with other manners of attaching a circuit board to a luminaire in a manner sufficient to create a thermal connection there between.

There is a need for a luminaire overcoming the issues described above and of the type described herein.

SUMMARY OF THE DISCLOSURE

A luminaire is disclosed comprising a housing comprising a housing plate and a lens frame; a circuit board defining a front side and a rear side, the circuit board rear side resting on the housing plate; a plurality of light sources extending from the front side of the circuit board; a plurality of circuit board bosses mounted to the front side of the circuit board; a lens held between the lens frame and the circuit board bosses such that the lens presses the circuit board against the housing plate. The housing plate may act as heat sink to draw heat from the circuit board. The housing plate may define a substantially planar surface. The circuit board may rest on the substantially planar surface of the housing plate. At least one of the plurality of light sources may be an LED. The circuit board bosses may extend from the circuit board front side to a distal end in contact with the lens. The circuit board bosses may extend from the circuit board front side to a distal end that extends further from the circuit board front side than any light source. The circuit board bosses may comprise a body and at least one terminal extending from the body and connected to the circuit board. The circuit board bosses may comprise a body and at least one terminal extending from the body and soldered to the circuit board. The circuit board boss may have a body comprised of silicone. The circuit board bosses may have a body and a mounting leg extending from the body to a mounting plate connected to the circuit board.

Another luminaire is disclosed comprising a housing comprising a housing plate; a circuit board defining a front side and a rear side, the circuit board rear side resting on the housing plate; a plurality of circuit board bosses mounted to the front side of the circuit board and extending outward from the circuit board to a circuit board boss distal end; and a lens in contact with the circuit board boss distal ends and biased toward the circuit board such that the lens presses the circuit board against the housing plate. The circuit board may comprise light sources. The housing may comprise a lens frame biasing the lens toward the circuit board.

Another luminaire is disclosed comprising: a housing comprising a housing plate and a lens frame; a circuit board defining a front side and a rear side, the circuit board rear side resting on the housing plate; a plurality of light sources extending from the front side of the circuit board: a lens having a plurality of posts extending therefrom toward a distal end in contact with the circuit board such that the lens presses the circuit board against the housing plate, at least one of the plurality of posts comprising a plurality of fingers at the distal end. The housing plate may act as heat sink to draw heat from the circuit board. The circuit board may define an aperture which defines an aperture perimeter and the plurality of fingers in contact with the aperture perimeter. A distal end of the fingers may define a distal end of the post and defining a wedge, and the circuit board defining an aperture which defines an aperture perimeter and the wedge of at least one finger in contact with the aperture perimeter. At least one of the posts may be formed integrally with the lens. At least one of the posts may be comprised of the same material as the lens. The lens may be concave.

BRIEF DESCRIPTION OF THE DRAWINGS

Aspects and embodiments of the present disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings:

FIG. 3A depicts a perspective view of the circuit board of the luminaire of FIG. 1;

FIG. 3B depicts a portion of the circuit board of FIG. 3A identified as 3B and showing a circuit board boss on the circuit board;

FIG. 3C depicts a portion of the circuit board of FIG. 3A identified as 3C and showing a circuit board boss exploded from the circuit board;

FIG. 4A depicts a top-side perspective view of a circuit board boss of the luminaire of FIG. 1;

FIG. 4B depicts a bottom-side perspective view of a circuit board boss of the luminaire of FIG. 1;

FIG. 4C depicts a top-side perspective view of one embodiment of a terminal of the circuit board boss of the luminaire of FIG. 1;

FIG. 4D depicts a bottom-side view of the terminal of FIG. 4C;

Figure 1:
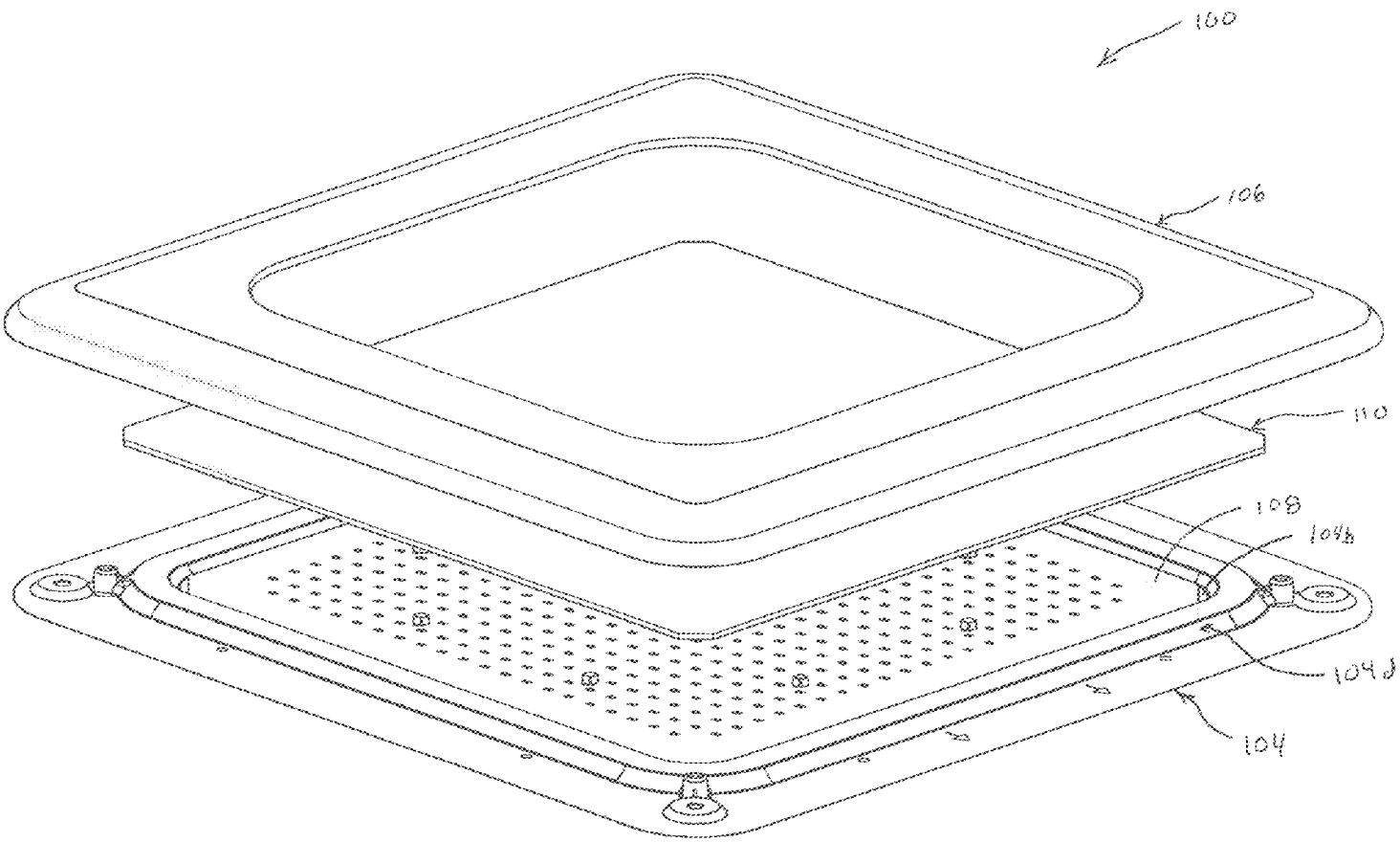
FIG. 1 depicts an exploded perspective view of a luminaire in accordance with a first embodiment of the present invention.

The embodiments depicted in the drawing are merely illustrative. Variations of the embodiments shown in the drawings, including embodiments described herein, but not depicted in the drawings, may be envisioned and practiced within the scope of the present disclosure.

DETAILED DESCRIPTION

Aspects and embodiments of the present disclosure provide luminaires and elements thereof. Luminaires according to the present disclosure can be used for new installations or to replace existing luminaires or elements thereof. Such luminaires and elements afford light distribution and lower costs due to simple and efficient product configuration and corresponding assembly which lower manufacturing and assembly costs. Such luminaires also provide increased thermal management resulting in higher operating efficiencies through reduced energy consumption and maintenance.

A first exemplary embodiment of such a luminaire is luminaire 100 depicted in FIG. 1 as having a housing 102 comprised of a housing plate 104 and a lens frame 106 for being connected to the housing plate 104. A circuit board 108 defines a rear side 108*a* and a front side 108*b*. The circuit board rear side 108*a* rests on the housing plate 104 and has a plurality of light sources 112 formed on, or secured to the circuit board front side 108*b* for generating light. The present disclosure will be described at times as using LEDs as the light sources 112, other light sources now know or hereafter developed may be used in addition to LEDs or instead of LEDs within the scope of the present disclosure. By way of example only, other light sources such as plasma light sources may be used. Further, the term "LEDs" is intended to refer to all types of light emitting diodes including organic light emitting diodes ("OLEDs").

Figure 2A:
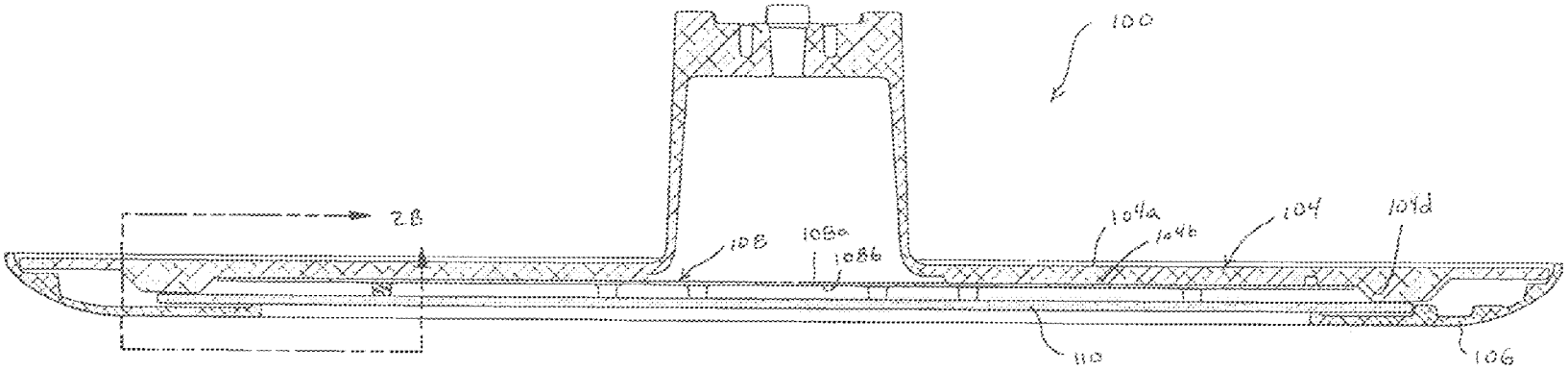
FIG. 2A depicts a cross-sectional view of the luminaire of FIG. 1.
Figure 2B:
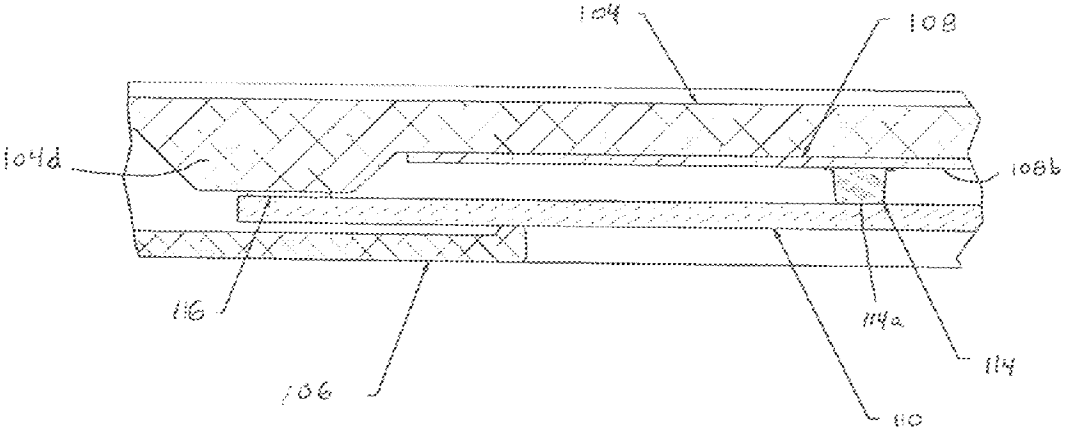
FIG. 2B depicts a portion of the cross-sectional view of FIG. 2A identified as 2B.
Figure 5B:
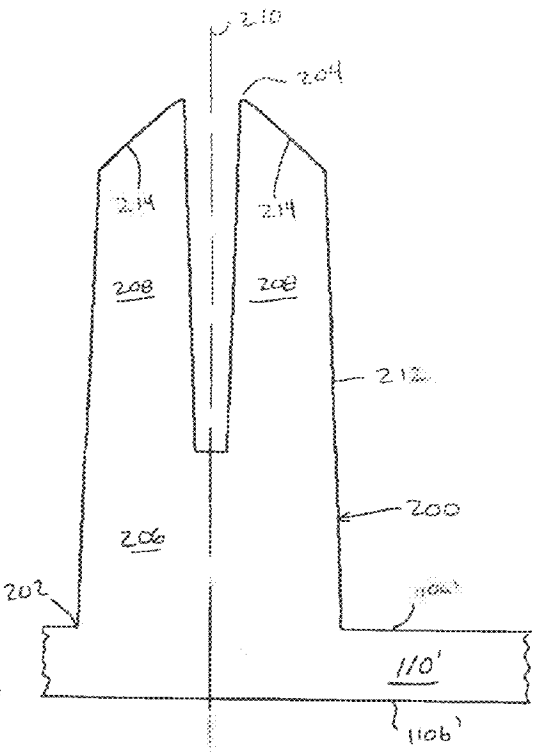
FIGS. 5A-5C depict perspective, side and top views of one embodiment of a lens post of the second embodiment.
Figure 5C:
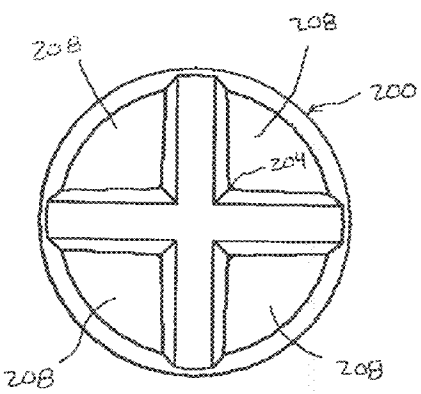
Figure 5A:
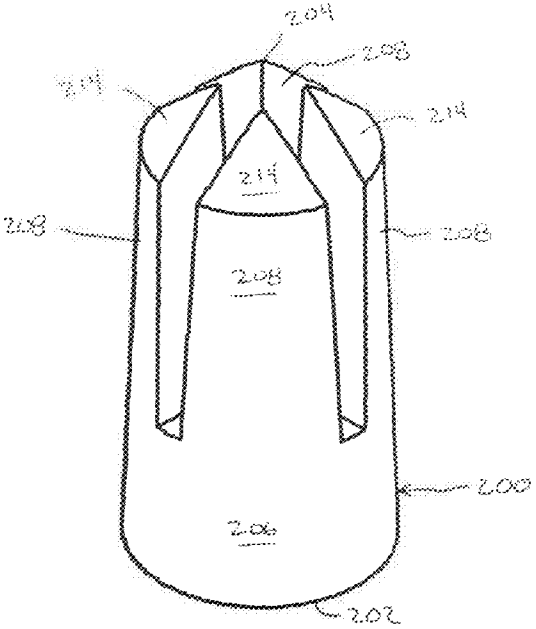

A plurality of circuit board bosses 114 are distributed over the circuit board front side 108*b* and extend farther from the circuit board front side 108*b* than any light source 112. A protective lens 110 is held between the housing plate 104 and the lens frame 106 such that the lens 110 is pressed against the circuit board bosses 114 forcing the circuit board rear side 108*a* into firm contact with the housing plate 104 to facilitate excellent thermal conductivity between the circuit board 108 and the housing plate 104. In this configuration, the housing plate may act as a heat sink drawing heat from the circuit board 108, including the light sources 112. Because the circuit board bosses 114, along with force from the lens 110, provide intimate contact between the circuit board rear side 108*a* and the housing plate 104, the circuit board 108 need not be connected to the housing with screws or other typical connection hardware. The need for holes in the housing 102 to accept such connection hardware and/or threading of such holes is eliminated by the luminaire 100. As depicted in the embodiment of FIGS. 2A and 2B, the circuit board bosses need not contact the housing plate to maintain the intimate contact between the circuit board rear side 108*a* and the housing plate 104. Assembly operations to connect the circuit board 108 to the housing 102 with such connection hardware, and the associated risk of damaging the circuit board 108 during such operations, is also eliminated.

In one exemplary embodiment of the disclosed luminaire 100, the housing plate 104 defines a rear side 104*a* and a front side 104*b*. The rear side 104*a* may comprise heat dissipation fins (not depicted) or other features (not depicted) to increase heat transfer from the housing plate 104 to the surrounding environment. The housing plate front side 104*b* defines a substantially planar surface 104*c* across a majority of its face to accept and provide intimate contact with circuit board rear side 108*a*, which is also substantially flat. In alternative embodiments, the face of the housing plate front side need not be substantially planar if the circuit board 108 is not substantially planar since the objective is to have as much thermal contact as possible between the circuit board rear side 108*a* and the housing plate front side 104*b*. The substantially planar surface 104*c* of the housing plate 104 is surrounded by a lens boss 104*d* that extends about the periphery of the substantially planar surface 104*c* like a bank.

As depicted in FIGS. 2A and 2B, the housing plate lens boss 104*d* extends beyond the circuit board front side 108*b* and the light sources 112. The lens 10 rests on the housing plate lens boss 104*d* and elevates the lens 106 above the circuit board 108 and the light sources 112. As depicted in FIG. 2B (but not 2A for purposes of clarity), a seal 116 (comprised or urethane or the like) may optionally sit between the housing plate lens boss 104*d* and the lens 110 to seal out moisture, dirt, etc. from reaching the circuit board 108.

The circuit board bosses 114 are depicted as approximating a cube shaped body, although other shapes (e.g. cylindrical) are also contemplated, defining a distal end 114*a* for engaging the lens when the luminaire 100 is assembled and a proximate end 114*b* located in contact with, or adjacent to, the circuit board 108 when affixed thereto. The proximate end 114*b* of the body of each circuit board boss 114 defines two recesses 114*c* on opposing sides. A terminal 114*d* extends out of each recess 114*c*.

In one embodiment of the circuit board boss terminals 114*d* depicted in FIGS. 4C and 4D, the terminals 114*d* comprise a U-shaped bracket 150 having two curved arms 151 forming the U-shape and extending parallel to the flat circuit board boss proximate end 114*b* of the boss body and inside a portion of the body. A short downwardly depending leg 152 extends downward from the end 154 of each curved arm 151 forming the mouth of the U-shape. The downwardly depending leg 152 extends approximately perpendicular to the curved arms 151. A small end plate 156 extends outward from each downwardly depending leg 152 approximately parallel to the curved arms 151. In one embodiment, the end plates 156 may extend outside of the boss body. A mounting leg 158 extends downwardly from the bracket 150 approximately perpendicular to the bracket 150. A mounting plate 160 extends approximately parallel to the bracket 150. The connector plate 158 and connector plate 160 extend outside of the boss body to facilitate connection of the circuit board 108. The boss terminal 114*d* can be formed of metal or other material.

The circuit board boss terminal connector plates 160 each have an associated solder pad 108*c* on the circuit board 108 and to which the connector plates 160 are affixed via soldering, preferably during the circuit board manufacturing process, to affix the circuit board bosses 114 to the circuit board 108. Other manners of affixing the circuit board boss terminals 114*d* to the circuit board 108 are also contemplated. For example, an adhesive could replace the circuit board boss terminals 114*d* and the circuit board solder pads 108 such that the circuit board boss 114 is adhered to the circuit board 108.

The body of each circuit board boss 114 may be comprised of silicone or other like material. It has been found that a hardness measuring approximately between 60 A and 70 A on a durometer is sufficient to achieve the purpose described herein. Other hardness values and/or materials will also facilitate the objectives of this disclosure. In the depicted embodiment, the circuit board bosses 114 have draft angled sides and rounded corners to facilitate mold release.

The lens frame 106 is secured to the housing plate 104 with screws or the like such that the lens frame 106 forces the lens 110 against the seal 116, if present, and against the distal end 114*a* of each circuit board boss 114 on the circuit board 108. This, in turn, forces the proximate end 114*b* each circuit board boss 114 against the circuit board 108 front side 108*b* which, in turn forces the circuit board rear side 108*a* against the housing plate front side 104*b* to facilitate heat transfer. A thermally conductive grease or the like could also be inserted between the housing plate front side 104*b* and the circuit board rear side 108*a* to maximize thermal contact.

In order to assure that the circuit board bosses 114 create the desired forces discussed above, the height of the circuit board bosses 114 need be high enough that the distal end extend beyond the housing plate lens boss 104*d* and the seal, if any, so that securement of the lens frame 106 and lens 110 to the housing plate 104 compresses the circuit board bosses 114. The relative height of the circuit board bosses 114 to the housing plate lens boss 104*d* and seal, if any, as well as the hardness of the circuit board bosses 114 should be designed to provide an appropriate amount of force on the circuit board to achieve the desired thermal contact between the circuit board rear side 108*a* and the housing plate front side 104*a* without providing so much force as to crack or otherwise damage the circuit board 108. These aspects are determinable by one of ordinary skill in the art after having read this disclosure.

In the depicted embodiment, the circuit board bosses 114 are spread somewhat evenly across the circuit board 108 in order to somewhat evenly distribute the force applied to the circuit board 108. It will be recognized that a balance must be struck between the cost that the circuit board bosses 114, as well as their installation, and using enough circuit board bosses 114 to spread the force out across the circuit board 108 to maximize thermal contact between the circuit board 108 and the housing plate 104. The embodiment of FIG. 3A depicts an outer ring of circuit board bosses 114 close to the outer perimeter of the light sources 112 on the circuit board 108 and an inner ring of circuit board bosses 114 closer to the center of the circuit board 108. It will be recognized that other distributions will also provide adequate distribution of force across the circuit board 108.

A second exemplary embodiment of a luminaire of the present invention comprises a housing having a housing plate 104' and a lens frame for being connected to the housing plate, all as described and depicted with regard to the luminaire 100 of the first embodiment. The second embodiment luminaire also comprises a circuit board 108' of the same configuration and placement as the circuit board 108 of the first embodiment luminaire 100, defining a rear side 108*a'* and a front side 108*b'* with the circuit board rear side 108*a'* resting on the housing plate 104' and having a plurality of light sources 112' formed on, or secured to the circuit board front side 108*b'* for generating light. Unlike the first embodiment luminaire 100, the second embodiment luminaire has no circuit board bosses on the circuit board 108'.

Like the first embodiment, the second embodiment also has a protective lens 110' that is held between the housing plate 104' and the lens frame. The lens 110' defines an inner side 110*a'* and an outer side 110*b'*. Unlike the lens 110 of the first embodiment, the lens 110' of the second embodiment luminaire comprises a plurality of posts 200 extending from the lens inner side 110*a'* toward the circuit board 108'. The posts 200 are configured and sized to press the circuit board 108' against the housing plate front side 104*b'* to facilitate contact and thermal conductivity, as discussed in the first embodiment luminaire 100. Like the circuit board bosses 114 of the first embodiment, the posts 200 eliminate any need for the circuit board 108' to be connected to the housing with screws or other typical connection hardware. The need for holes in the housing plate 104' or other portions of the housing 102' to accept such connection hardware and/or threading of such holes is also eliminated. Assembly operations to connect the circuit board 108' to the housing 102' with such connection hardware, and the associated risk of damaging the circuit board 108' or the housing 102' during such operations is therefore also eliminated.

One embodiment of the lens post 200 of the second embodiment is depicted in FIGS. 5A-5C and 6A-6B. Each post 200 comprises a proximate end 202 connected to the lens 110' and a distal end 204 distal to the lens 110' for contacting the circuit board 108'. Each post 200 is preferably configured as a tapered cylinder tapering from the proximal end 202 toward the distal end 204 to facilitate a molding draft angle as well as increasing flexibility, as discussed below. The post 200 terminates in a chamfered tip at the distal end 204 defining a wedge 214.

Each post 200 defines a preferably solid base 206 from which extending from the lens 110'. The remainder of the post 200, including and extending beyond the chamfered tip, defines a cross-shaped cutout defining four fingers 208, which are preferably like-shaped, forming a 90' angle near the post longitudinal axis 210 and rounded at the outer perimeter 212 of the post 200. The term "cutout" is not intended to imply any method of formation of the posts 200 or fingers 208, which may include, as discussed above, molding. The chamfered tip of each finger 208 defines the wedge 214 angled from the post outer perimeter 212 inward to the post distal end 204, which defines the most distal portion of the finger 208 and the lens post 200.

In the luminaire of this embodiment, the circuit board 108' defines a plurality of apertures 216 defined by a circuit board aperture inner edge 216*a* in the front side 108*b* of the circuit board. The aperture may, but need not depending on the thickness of the circuit board, extend as a through-hole through to the circuit board rear side 108*a* as in the depicted embodiment.

Figure 6A:
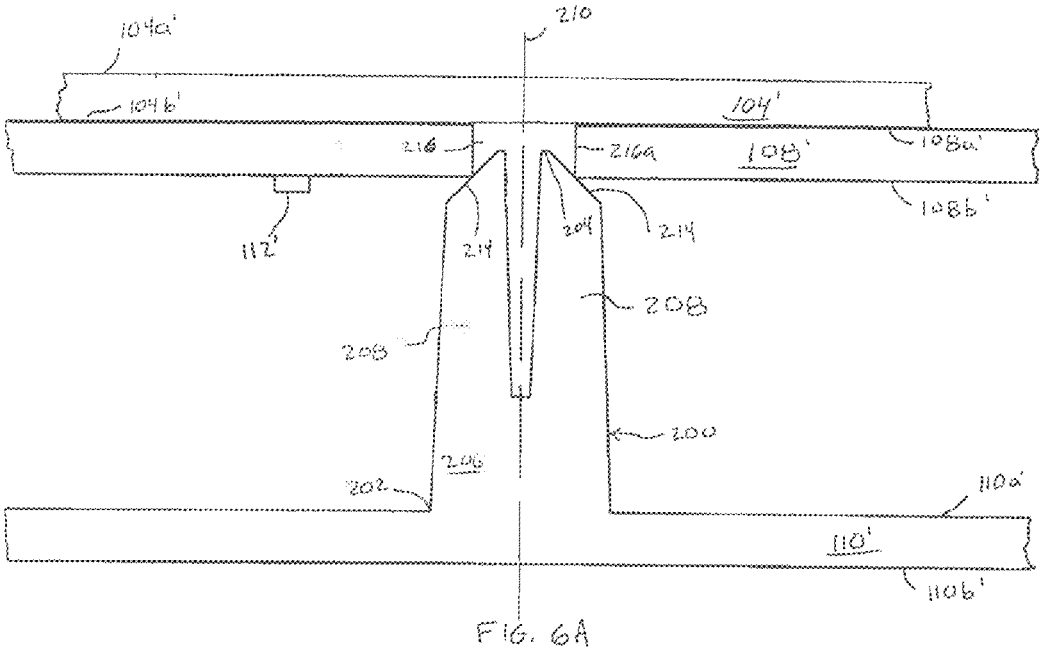
FIG. 6A depicts a cross-sectional view of a lens post of FIGS. 5A-C assembled in a luminaire and in contact with an associated circuit board holding the circuit board against the luminaire housing.
Figure 6B:
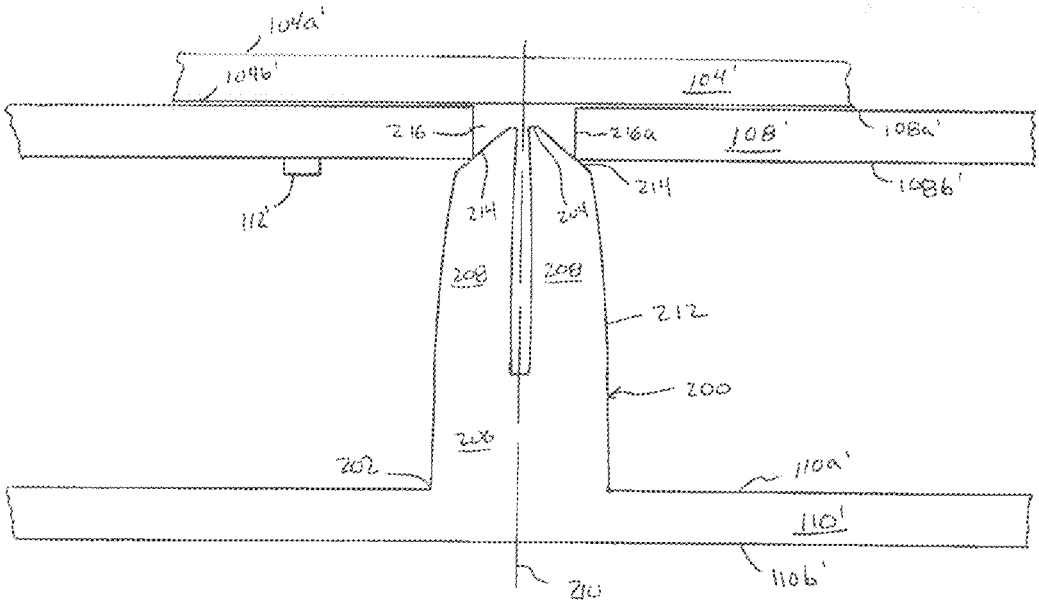
FIG. 6B depicts a cross-sectional view of a lens post of FIGS. 5A-5C assembled in a luminaire and in contact with an associated circuit board holding the circuit board against luminaire housing and the lens post fingers flexing.

Each aperture 216 is sized slightly larger than necessary to receive the distal end 204 of the associated finger 208. Each aperture 216 is aligned with one of the wedges 214 on the fingers 208 such that each post distal end 204 is located in an associated circuit board aperture 216 with a portion of the wedges 214 in contact with a portion of the circuit board aperture inner edge 216*a* or the rim it forms at the circuit board front side 108*b*. The length of each post 200 is configured such that the distal end 204 of each finger 208 will extend into an associated circuit board aperture 216 when the luminaire of the second embodiment is fully assembled. This configuration is depicted in FIG. 6A. This configuration creates good thermal contact between the circuit board rear side 108*a*' and the housing plate front side 104*b*' to allow the housing plate 104 to act as a heat sink for heat generated by the light sources 112' and/or other elements of the circuit board 108'.

Depending on the exact length of the post 200, the exact diameter of the circuit board aperture 216, the exact thickness of the circuit board 108' as well as many other dimensions of the various portions of the luminaire of this second embodiment, the length of the lens post 200 may be longer necessary to achieve the desired thermal contact between the circuit board rear side 108*a*' and the housing plate front side 104*b*'. Such an unduly long lens post 200 can create problems in a luminaire such as cracking the circuit board 108' (which could lead to defective or no operation of the circuit board 108'), cracking of the lens 110', incomplete assembly of the lens frame to the housing plate 104' (potentially creating for a leak around a seal there between) or other problems. In order to prevent an unduly long lens post 200 from creating such problems, each finger 208 will flex inward toward the post longitudinal axis 210'. One exemplary depiction of such a flexed state appears in FIG. 6B. The flex of the finger 208 will create additional force against the circuit board 108' to cause thermal contact between the circuit board rear side 108*a*' and the housing plate front side 104*b*'. The flexibility of the fingers 208' facilitates not only additional force to generate this thermal contact, but it also provides an inherent tolerance range to accommodate variations in dimensions of the various elements of the luminaire of this second embodiment.

As discussed above, the circuit board aperture 216 could be a through aperture extending from the front side 108*b*' to the rear side 108*a*' or the circuit board aperture 216 could be replaced with a cup-shaped object on the circuit board front side 108*b*'. Other alternative configurations will be readily apparent.

The number of lens posts 200 and associated circuit board apertures 216 can be determined based on the size and weight of the circuit board, its rigidity and propensity to sag and other relevant features contributing to the force needed to create thermal contact between the circuit board rear side 108*a*' and the housing plate front side 104*b*'. It will be understood that some subset of the posts 200 could be configured as described above while others lack the described fingers 208 and associated flexibility. The posts 200 could be molded as part of the lens 110' or created separately and affixed to the remainder of the lens 110' with adhesive or the like.

In either of the above luminaire embodiments, the lens 110, 110' may optionally be manufactured to have concave curvature directing the centermost portion of the lens 110, 110' inward toward the light sources 112, 112', when the lens is in a relaxed state, to compensate for any sag in the lens 110, 110' occurring due to the weight of the lens 110, 110' as it extends inward from the lens frame without support or to compensate for sag in the circuit board 108, 108'. The extent of the curvature depends on the area covered by the lens 110, 110', the thickness and material from which the lens 110, 110' is constructed, the area covered by the circuit board 108, 108', its composition and distribution of elements and their associated weight and the thickness and material from which the circuit board 108, 108' is made. Other factors will also impact the necessary curvature of the lens 110, 110' to compensate for sag in the lens 110, 110' and/or the circuit board 108, 108'.

The LEDs used as the light sources 112, 112' in the exemplary embodiments herein can be of any kind, color (e.g., emitting any color or white light or mixture of colors and white light as the intended lighting arrangement requires) and luminance capacity or intensity, preferably in the visible spectrum. Color selection can be made as the intended lighting arrangement requires. In accordance with the present disclosure, LEDs can comprise any semiconductor configuration and material or combination (alloy) that produces the intended array of color or colors. The LEDs can have a refractive optic built-in with the LED or placed over the LED, or no refractive optic; and can alternatively, or also, have a surrounding reflector, e.g., that re-directs low-angle and mid-angle LED light outwardly. In one suitable embodiment, the LEDs are white LEDs each comprising a gallium nitride (GaN)-based light emitting semiconductor device coupled to a coating containing one or more phosphors. The GaN-based semiconductor device can emit light in the blue and/or ultraviolet range, and excites the phosphor coating to produce longer wavelength light. The combined light output can approximate a white light output. For example, a GaN-based semiconductor device generating blue light can be combined with a yellow phosphor to produce white light. Alternatively, a GaN-based semiconductor device generating ultraviolet light can be combined with red, green, and blue phosphors in a ratio and arrangement that produces white light (or another desired color). In yet another suitable embodiment, colored LEDs are used, such are phosphide-based semiconductor devices emitting red or green light, in which case the LED assembly produces light of the corresponding color. In still yet another suitable embodiment, the LED light board may include red, green, and blue LEDs distributed on the printed circuit board in a selected pattern to produce light of a selected color using a red-green-blue (RGB) color composition arrangement. In this latter exemplary embodiment, the LED light board can be configured to emit a selectable color by selective operation of the red, green, and blue LEDs at selected optical intensities. Clusters of different kinds and colors of LED are also contemplated to obtain the benefits of blending their output.

Although the embodiments described herein use LEDs to generate light rays, other light sources are also contemplated. The disclosed luminaire is not limited to use of LEDs.

While certain embodiments have been described herein, it will be understood by one skilled in the art that the methods, systems, and apparatus of the present disclosure may be embodied in other specific forms without departing from the spirit thereof. For example, while aspects and embodiments herein have been described in the context of certain applications, the present disclosure is not limited to such; for example, embodiments of the present disclosure may be utilized generally for any light distribution applications.

Accordingly, the embodiments described herein, and as claimed in the attached claims, are to be considered in all respects as illustrative of the present disclosure and not restrictive.

What is claimed is:

1. A luminaire comprising:

a housing plate and a lens frame;

a circuit board defining a front side and a rear side, the circuit board rear side in contact with the housing plate;

a plurality of light sources extending from the front side of the circuit board;

a plurality of circuit board bosses mounted to the front side of the circuit board, the circuit board bosses not in contact with the housing plate, at least one of the circuit board bosses defining approximately a cube shape having a proximate end in contact with the circuit board and a distal end;

a lens held between the lens frame and the distal end of the at least one circuit board boss such that the lens presses the circuit board against the housing plate.

2. The luminaire of claim 1, the housing plate acting as heat sink to draw heat from the circuit board.

3. The luminaire of claim 1, the housing plate defining a substantially planar surface.

4. The luminaire of claim 3, the circuit board resting on the substantially planar surface of the housing plate.

5. The luminaire of claim 1 wherein at least one of the plurality of light sources is an LED.

6. The luminaire of claim 1, wherein the circuit board bosses extend from the circuit board front side to a distal end in contact with the lens.

7. The luminaire of claim 1, wherein the circuit board bosses extend from the circuit board front side to a distal end that extends further from the circuit board front side than any light source.

8. The luminaire of claim 1, wherein the circuit board bosses comprise a body and at least one terminal extending from the body and connected to the circuit board.

9. The luminaire of claim 1, wherein the circuit board bosses comprise a body and at least one terminal extending from the body and soldered to the circuit board.

10. The luminaire of claim 1 wherein the circuit board boss having a body comprised of silicone.

11. The luminaire of claim 1, the circuit board bosses having a body and a mounting leg extending from the body to a mounting plate connected to the circuit board.

12. A luminaire comprising:

comprising a housing plate;

a circuit board defining a front side and a rear side, the circuit board rear side in contact with the housing plate;

a plurality of circuit board bosses mounted to the front side of the circuit board and extending outward from the circuit board to a circuit board boss distal end, each of the plurality of circuit board bosses defining approximately a cube shape, the circuit board bosses not in contact with the housing plate;

a lens in contact with the circuit board boss distal ends and biased toward the circuit board such that the lens presses the circuit board against the housing plate.

13. The luminaire of claim 12 wherein the circuit board comprises light sources.

14. The luminaire of claim 12 wherein the housing comprises a lens frame biasing the lens toward the circuit board.

15. A luminaire comprising:

a housing comprising a housing plate and a lens frame;

a circuit board defining a front side and a rear side, the circuit board rear side resting on the housing plate;

a plurality of light sources extending from the front side of the circuit board;

a lens having a plurality of posts extending therefrom toward a distal end in contact with the circuit board such that the lens presses the circuit board against the housing plate, at least one of the plurality of posts comprising a plurality of fingers at the distal end.

16. The luminaire of claim 15, the housing plate acting as heat sink to draw heat from the circuit board.

17. The luminaire of claim 15, the circuit board defining an aperture which defines an aperture perimeter and the plurality of fingers in contact with the aperture perimeter.

18. The luminaire of claim 15 wherein a distal end of the fingers defining a distal end of the post and defining a wedge, and the circuit board defining an aperture which defines an aperture perimeter and the wedge of at least one finger in contact with the aperture perimeter.

19. The luminaire of claim 15, at least one of the posts is formed integrally with the lens.

20. The luminaire of claim 15 wherein at least one of the posts is comprised of the same material as the lens.

21. The luminaire of claim 15 wherein the lens is concave.

* * * * *